United States Patent [19]

Hujo

[11] Patent Number: 4,907,482

[45] Date of Patent: Mar. 13, 1990

[54] GUIDE FOR HAND HELD POWER SAWS

[76] Inventor: Lawrence W. Hujo, 3407 Mardale Dr., Jeffersontown, Ky. 40299

[21] Appl. No.: 160,596

[22] Filed: Feb. 26, 1988

[51] Int. Cl.[4] ..... B27B 9/04

[52] U.S. Cl. ..... 83/745; 83/581; 83/574; 83/761

[58] Field of Search ..... 83/581, 574, 745, 743, 83/761

[56] References Cited

U.S. PATENT DOCUMENTS

| | | | |
|---|---|---|---|
| 3,124,175 | 3/1964 | McCloud | 83/581 X |
| 3,815,463 | 6/1974 | Allaire | 83/581 X |
| 4,054,077 | 10/1977 | Gram | 83/745 |
| 4,608,899 | 9/1986 | Twigger et al. | 83/745 |

*Primary Examiner*—Donald R. Schran

[57] ABSTRACT

The Crownmaster is a tool used as a guide, with a hand held circular power saw, in the cutting of crown moulding, for inside and outside corners. Specifically, the Crownmaster allows the user to simultaneously make the angle cut and the bevel cut in crown moulding.

3 Claims, 1 Drawing Sheet

GUIDE FOR HAND HELD POWER SAWS

The present invention is a guide for hand held power saws which is particularly intended for cutting crown moulding and is an invention of Mr. Lawrence W. Hujo, United States Citizen, 3407 Mardale Drive, Jeffersontown, Kentucky 40299.

RELATED APPLICATION

None

SUMMARY OF INVENTION

The present invention is a new and useful tool designed for use in the installation of architectural crown moulding. The present invention allows the user to install the moulding in a fast, easy and professional manner. Specifically, the tool permits the user to angle cut crown moulding using only a hand held power circular saw; the device thus permits the user to avoid using cumbersome and expensive equipment such as miter boxes.

REFERENCE TO DRAWING

FIG. 4 is a legend corresponding to FIGS. 1–3; and

FIG. 5 is a legend corresponding to FIGS. 1–3.

DETAILED DESCRIPTION OF THE INVENTION

Figure 3:
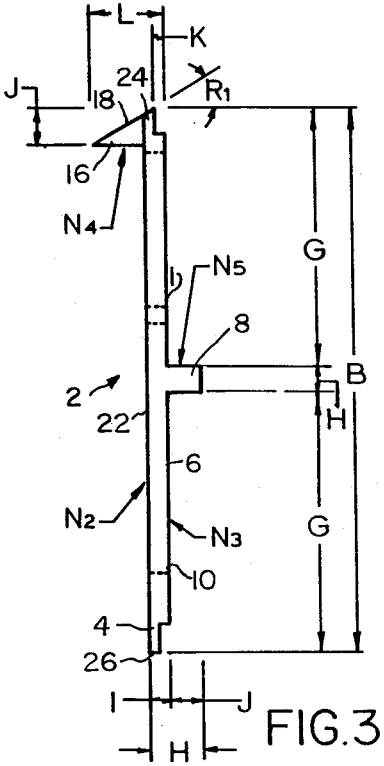
FIG. 3 is a right side view thereof.
Figure 1:
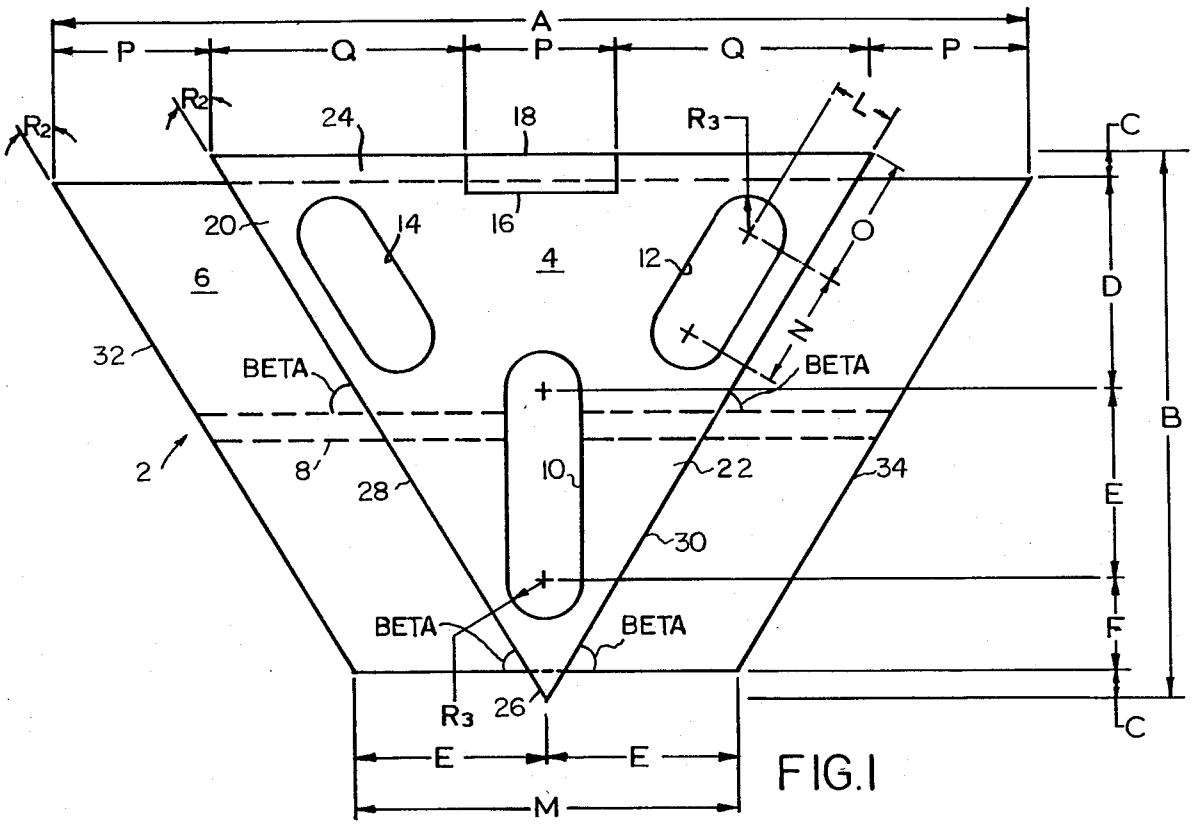
FIG. 1 is a top plan view of the device of the present invention.
Figure 2:
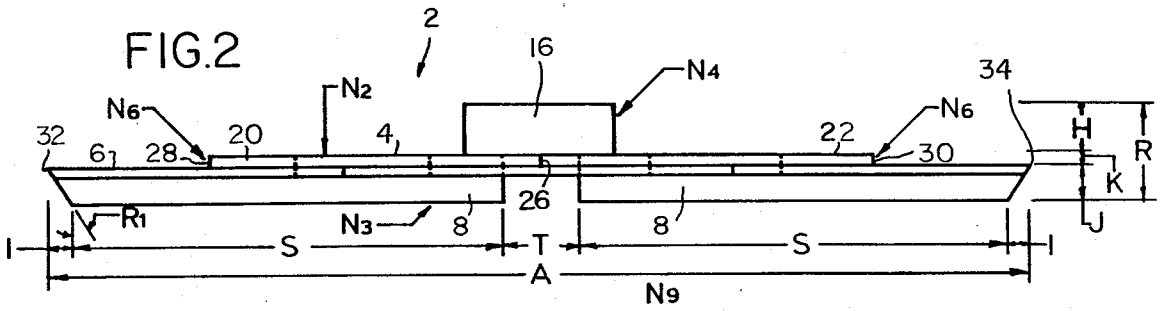
FIG. 2 is a front view thereof.

1. Description of the Invention:

The guide of the present invention is hand held and triangular in shape; it is designed so as to allow its use with any brand of circular power saw. The present invention is used as a guide for the saw.

The guide of the present invention employs the use of two basic angles, referred to as the "angle cut" and the "bevel cut" or undercut. For the Crown moulding to fit in corners, either inside corners or outside corners, the angle cut must be 59° (fifty-nine degrees) and the bevel cut or under-cut must be 33.85° (thirty-three and eighty-five one hundreds degrees). The guide of the present invention allows the user, in tandem with a circular power saw, to make both cuts simultaneously.

The guide 2, with its triangular shape, employs these two angles. The angle of cut is maintained by a triangle 4 mounted atop of a base plate 6. This triangle is referred to as the guide rail 4 guide rail will maintain an angle of 59° (fifty-nine degrees) to the fence 8. The circular saw rides atop of the base plate and against the guide rail, with the material to be cut placed under the base plate 6 and against the fence, 8 which is a rail not to exceed $\frac{5}{8}$ (five-eighths) of an inch in depth protruding down from the bottom side of the base plate 6. The guide 2 has a series of holes 10, 12, 14 through the table to allow the user to hold the material to be cut firmly against the fence 8.

Either mounted or molded into the top of the triangle 4 is a bevel adjusting guide, 16. The outer edge 18 of the bevel adjusting guide 16 is at an angle R1, which is 33.85° from the vertical. It is this side 18 of the bevel guide 16 which allows the user to set the circular saw angle at precisely 33.85° (thirty-three and eighty-five one hundred degrees). This maintains the proper bevel of the cut. The Bevel adjustments are made by laying the guide 2 on a flat surface with the triangle 4 face down and setting the circular saw atop of the base plate 6 then, using the circular saw bevel adjusting screw, the saw blade is set against the bevel adjusting guide and tightened, thereby maintaining the proper bevel on the cut.

The triangular shape of the saw guide rail allows the user to use either the "left" 20 or "right" 22 end of the guide 2. The back of the triangle 4 is the longest leg 24, and the front of the triangle 4 is the angular point 26. This will give the user the right and left sides and the saw cut will always be made from the short to the long point on the right and from long point to the short point on the left side. The fence 8 referred to above, is placed on the bottom in the center and runs from left to right. The bevel guide, referred to above, is mounted on the top of the triangle and appears as a triangular shaped bar, which is four inches long and is in the center of the longest leg of the triangle, running left to right.

2. Enabling Disclosure

The guide rail 4 of the present invention is triangular in shape, is mounted to a table 6 and is used as a guide rail for a circular power saw. The triangle causes the saw to cut crosscuts on crown moulding at a precise 59° (fifty-nine) degree angle. The angle beta between the left side 20 of the guide rail and the fence 8 is the same as the supplementary angle beta between the right side 22 of the guide rail and the fence 8, and the angle beta is 59°. The table is wider than the guide rail so the guide edges 28, 30 of the guide rail are inside the side edges 32, 34 of the base plate 6, and the circular saw sits on top of the table and rides across the table. Mounted on the bottom of the base plate 6 is a $\frac{3}{4}$ (three-fourths) of an inch wide by $\frac{5}{8}$ (five-eights) of an inch deep rail which runs from right side to the left side of the base plate 6 and is referred to as the fence and this fence 8 runs the length of the table 6. The fence is mounted on the center line of the table and allows the material to be cut from either the front to back or back to front of the guide 2.

There are three holes 10, 12, 14 cut through the guide 2 The front hole 10 extends from the center of the triangular guide 4 forward toward the point 26. The left hole 12 and right hole 14 run parallel to the left and right side 22, 24 of the guide rail 4, respectively.

The length of the base plate 6 on the long side is $25\frac{1}{2}$ (twenty-five and one-half) inches long and measures 13 (thirteen) inches wide. The width and the length can be changed to allow use with wider material. The angle of the cut is 59° (fifty-nine) degrees and the bevel is to be 33.85° (thirty-three and eighty-five one hundreds) degrees this bevel along with the angle of the cut must be maintained. The bevel guide which is placed on the top side of the guide rail 4 and is used to set the proper bevel on the circular saw.

The guide 2 can be manufactured in 4 (four) separate simple pieces or it could be moulded into one piece.

3. Mode of Operation:

To use the guide, the circular saw rests on the top of the table and the saw base plate rides guide edge 28 or 30 of the saw guide rail and the saw is always placed so as the blade is at the farthest point away from the guide rail and the bevel is under. The right end of the guide rail 4 guides the base plate of the circular saw which makes the cut from short point of cut to long point of cut on the material, and the left end of the guide 2 guides the saw which makes the cut from the long point of the cut to the short point of the cut. The material is always placed against the fence so the saw is pushing the material into the fence. After the material to be cut is marked to the desired length, then the guide 2 is placed atop of the material for use. The guide 2 permits the user to make cuts for both outside and inside crown moulding corners, as follows:

(1) Outside Corners

A. Left Side Outside Corner[2]

Place the guide 2 on the crown moulding with the moulding face up and the top edge of the moulding against the fence and cut the material on the right end of the guide or from the short point of cut to the long point of the cut and the bevel cut under.

Bottom is short point.

B. Right Side Outside Corner[3]

Rotate the guide 2 180° so the user is facing the longest side 24 or back of the guide 2. Lay the guide 2 on the moulding with the moulding face up with the bottom edge of the moulding against the fence and cut the material on the left end of the guide 2 or from long point of cut to the short point of the cut with the bevel cut under guide 2 in its normal front-facing position.

Bottom is short point.

(2) Inside Corners

A. Left side Inside Corner[4]

Place the CM on top of the moulding with the moulding lying face down and the bottom edge of the moulding against the fence now cut the material using the right end of the guide 2 making the cut from the short point of the cut to the long point of the cut and the bevel of the cut under. Note: at this point the user can either cope the material which is an industry standard practice or the user can cut the right side of an inside corner.

Bottom is long point (in corner).

B. Right Side Inside Corner[5]

Place the and rotate the guide 2 180° so the user is facing the longest side 24 or back of the guide 2. moulding face down guide the top edge of the moulding against the fence and cut the material on the left end of the guide or from long point of the cut to the short point of the cut.

Bottom is long point (in corner).

I claim:

1. A guide for cutting compound miters in crown moulding with a circular saw, comprising:

a substantially flat base plate defining a side edge;

a guide rail mounted on top of the base plate and defining a guide edge lying inside the side edge of the base plate, so a circular saw can rest on the base plate and be guided by the guide edge;

a fence mounted on the underside of said base plate at an angle of approximately 59° to the guide edge of the guide rail; and a bevel adjusting member mounted on the guide, said bevel adjusting member having one side at an angle of approximately 33.85° from the vertical, wherein the bevel adjusting member can be used to set the angle of the blade on a circular saw.

2. A guide for cutting compound miters in crown moulding with a circular saw as recited in claim 1, wherein the base plate defines at least one opening through which an operator can grasp a workpiece to hold it against the fence.

3. A guide for cutting compound miters in crown moulding with a circular saw as recited in claim 2, wherein the base plate defines a second side edge and the guide rail defines a second guide edge lying inside the second side edge of the base plate, wherein the second guide edge is also at a supplementary angle of approximately 59° to the fence, and wherein the two guide edges intersect to form a point.

* * * * *